US006957880B2

(12) United States Patent
Kawatoko et al.

(10) Patent No.: US 6,957,880 B2
(45) Date of Patent: Oct. 25, 2005

(54) INK JET PRINTING APPARATUS AND METHOD OF CONTROLLING TEMPERATURE OF HEAD OF INK JET PRINTING APPARATUS

(75) Inventors: Norihiro Kawatoko, Kanagawa (JP); Hiroshi Tajika, Kanagawa (JP); Miyuki Fujita, Tokyo (JP); Yuji Konno, Kanagawa (JP); Takayuki Ogasahara, Kanagawa (JP); Tetsuya Edamura, Kanagawa (JP); Tetsuhiro Maeda, Kanagawa (JP); Atsuhiko Masuyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 399 days.

(21) Appl. No.: 10/206,105

(22) Filed: Jul. 29, 2002

(65) Prior Publication Data

US 2003/0025748 A1 Feb. 6, 2003

(30) Foreign Application Priority Data

Jul. 31, 2001 (JP) ..... 2001-232916

(51) Int. Cl.[7] ..... B41J 29/38; B41J 29/393; B41J 2/05

(52) U.S. Cl. ..... 347/14; 347/17; 347/19; 347/60

(58) Field of Search ..... 347/10, 11, 12, 347/14, 17, 19, 60

(56) References Cited

U.S. PATENT DOCUMENTS

| | | | | |
|---|---|---|---|---|
| 5,168,284 A | | 12/1992 | Yeung | 347/17 |
| 5,475,405 A | | 12/1995 | Widder et al. | 347/14 |
| 5,477,246 A | | 12/1995 | Hirabayashi et al. | 347/12 |
| 5,861,895 A | | 1/1999 | Tajika et al. | 347/14 |
| 5,880,751 A | | 3/1999 | Nishikori et al. | 347/14 |
| 5,894,314 A | | 4/1999 | Tajika et al. | 347/14 |
| 6,260,940 B1 | * | 7/2001 | Yamada et al. | 347/17 |
| 6,325,492 B1 | | 12/2001 | Koitabashi et al. | 347/14 |

FOREIGN PATENT DOCUMENTS

| | | |
|---|---|---|
| JP | 63-268667 | 11/1988 |
| JP | 2-45166 | 2/1990 |
| JP | 5-96718 | 4/1993 |
| JP | 5-220964 | 8/1993 |
| JP | 5-220965 | 8/1993 |
| JP | 2001-8009 | 1/2001 |

* cited by examiner

*Primary Examiner*—Juanita D. Stephens
(74) *Attorney, Agent, or Firm*—Fitzpatrick, Cella, Harper & Scinto

(57) ABSTRACT

The present invention relates to an ink jet printing apparatus which sufficiently heats a head even in a low-temperature environment, which enables a proper image to be printed by stably ejecting ink, and which can be inexpensively and simply constructed. According to the present invention, if the detected temperature of a printhead is lower than a first heating threshold temperature, a heating mode in which the printhead can be heated is set before a printing operation. Further, when the heating mode is set and the detected temperature of the printhead is lower than a second heating threshold temperature, a heating unit heats the printhead. Consequently, even in a low-temperature environment, the heating operation keeps ink in a desired condition suitable for printing.

9 Claims, 15 Drawing Sheets

| FIG.11A |
| --- |
| FIG.11B |

| FIG.12A |
| --- |
| FIG.12B |

INK JET PRINTING APPARATUS AND METHOD OF CONTROLLING TEMPERATURE OF HEAD OF INK JET PRINTING APPARATUS

This application is based on Patent Application No. 2001-232916 filed Jul. 31, 2001 in Japan, the content of which is incorporated hereinto by reference.

BACKGROUND OF THE INVENTION

1. Field of the Invention

The present invention relates to an ink jet printing apparatus that carries out printing using thermal energy and a method of controlling the temperature of a head of the ink jet printing apparatus, and in particular, to improvements in control of the head temperature in a low-temperature environment.

2. Description of the Prior Art

It is known that an ink jet printing apparatus or the like is subjected to various adverse effects of a variation in environmental temperature or in temperature of a head composed of integrated printing elements. This is because the temperature varies physical property values such as the viscosity or surface tension of ink. Further, with what is called a bubble jet (registered trade name) printing method of using thermal energy to generate bubbles in ink in order to eject the ink, a variation in temperature may vary the conditions under which bubbles are generated.

If these physical property values of ink and the bubble generation conditions vary, the amount of ink droplets ejected from a printhead or the accuracy of landing may vary, resulting in a variation in density, a nonuniform density, or a variation in tone.

Accordingly, for ink jet printing apparatuses, it is important to control the temperature of the head. A conventional method of controlling the temperature of the printhead is described in U.S. Pat. No. 5,861,895 and Japanese Patent Application Laid-Open No. 5-220964 (1993). This control method employs a configuration that uses a heater for heating the printhead (a heater exclusively used to control temperature or used both for ink ejection and for temperature control) and a temperature sensor detecting temperature related to the printhead to feed back the temperature detected by the temperature sensor so as to adjust the amount of heat generated by the heater. Another conventional method does not use such feedback control but provides open loop control such that the heater is regulated to achieve an arbitrary preset temperature.

Such methods of controlling the heater of the printhead are roughly classified into four types: methods of always adjusting the head temperature (using feedback control based on a detected temperature), methods of adjusting the head temperature at fixed time intervals (using feedback control based on a detected temperature), methods of adjusting the head temperature when it exceeds an environmental temperature (using feedback control based on a detected temperature), and methods of modulating the pulse width of a heat pulse.

Of these conventional temperature control methods, a known one detects the head temperature at the start of printing or during every printing operation for one line, and compares the detected temperature with a reference temperature to provide such control that the printhead is heated until a target temperature is reached if the detected temperature is lower than the reference temperature. In this case, a fixed upper limit is generally set for the heating time in order to limit a decrease in throughput associated with the heating operation to below the fixed value.

Furthermore, as disclosed in U.S. Pat. No. 5,168,284 and U.S. Pat. No. 5,475,405, the head temperature may be controlled in real time by comparing the head temperature with the reference temperature and adding a non-printing pulse to the head on the basis of a difference between the head temperature and the reference temperature.

Moreover, U.S. Pat. No. 6,260,940 discloses a technique of preheating the printhead during sheet feeding or during an acceleration or deceleration period of the printhead.

U.S. Pat. No. 5,861,895, mentioned previously, discloses a technique of varying the waveform of a drive signal on the basis of the head temperature to suppress a variation in amount of ink ejected from the printhead, the variation attributed to the head temperature, while reducing a self temperature increase.

Further, Japanese Patent Application Laid-open No. 5-220965 (1993) discloses a technique of using ejecting heating means (heater) to heat the printhead up to a first temperature and using subheating means having a subheater to heat the printhead up to a second temperature higher than the first temperature.

Furthermore, Japanese Patent Application Laid-Open No. 5-96718 (1993) discloses a technique of heating, if a plurality of transporting means are provided, the printhead using timing corresponding to a transporting operation of each transporting means.

Moreover, with a higher grade of an image to be printed, the adverse effects of a variation in density or tone associated with the head temperature are more serious. U.S. Pat. No. 5,477,246 discloses a technique of providing such control that the temperature is maintained depending on the type of printing in order to vary the amount of ink ejected from the head depending on whether the type of an object is a character or an image.

However, the above control is disadvantageous in that throughput decreases substantially owing to the heating time set for the head. In particular, if a text or the like using black, with which the temperature of the printhead does not increase significantly (self-increase in temperature) during a printing operation, is printed using a multipath printing process, the throughput decreases further markedly when the printhead is heated for every print line. To avoid this, it has been envisaged that an upper limit is set for the heating time. However, in this case, printing is executed with the printhead insufficiently heated. In particular, this tendency appears clearly in a portion of the image printed immediately after the start of printing, when a self temperature increase is small. Further, problems such as a nonuniform density are prone to occur. Accordingly, this method is improper for high-grade image printing.

Furthermore, to heat the printhead during printing in order to avoid a decrease in throughput, a printing pulse and a heating pulse must be individually controlled, thereby requiring the apparatus to be complicated. On the other hand, if the heating operation period is limited to the period in which no printing operation is performed, i.e. a sheet feeding period or a carriage acceleration or deceleration period, then insufficient heating may be provided during the heating operation period as with the case in which the upper limit on the heating time is set to a smaller value as described previously. Further, during the heating operation period, motors for the transporting system and carriage are accelerated or decelerated to increase power consumption. Thus, disadvantageously, if the printhead is to be further heated, the capacity of a power supply must be increased.

Further, it has been proposed that heat retention be executed depending on the type of printing by controlling heat retention when a noticeable high-grade image, which may create a problem as described above, is printed. However, in this case, advanced determining means is required which can automatically determine the image to be printed.

Furthermore, if it is determined whether or not the printhead is to be heated on the basis of the head temperature, the temperature of ink may vary with the environmental temperature even with the same head temperature. As a result, the behavior of ejection may vary. To avoid this, it has been envisaged that temperature detecting means is provided which measures the environmental temperature in addition to the head temperature. However, this increases costs and requires correction of a difference between the ink temperature and the environmental temperature caused by heat generated by the printing apparatus itself. Therefore, the required control is complicated.

SUMMARY OF THE INVENTION

It is an object of the present invention to provide an ink jet printing apparatus with an inexpensive and simple configuration which sufficiently heats a head even in a low-temperature environment and which enables a proper image to be printed by stably ejecting ink.

The present invention provides an ink jet printing apparatus that carries out printing by ejecting ink to a printing medium through nozzles formed in a printhead, the apparatus being characterized by comprising heating means for heating the printhead, temperature detecting means for detecting the temperature of the printhead, comparing means for comparing the temperature of the printhead with a predetermined first heating threshold temperature, heating mode setting means for setting, before a printing operation, a heating mode in which the printhead can be heated if the temperature of the printhead detected by the temperature detecting means is lower than the first heating threshold temperature, and control means for controlling the heating means on the basis of a result of the comparison executed by the comparing means and depending on whether or not the heating mode has been set, the control means using the heating means to heat the printhead when the heating mode has been set and when the detected temperature of the printhead is lower than the second heating threshold temperature.

Further, the present invention provides a method of controlling temperature of a head of an ink jet printing apparatus that carries out printing by ejecting ink to a printing medium through nozzles formed in the printhead, the method being characterized by comprising a heating step of heating the printhead, a temperature detecting step of detecting the temperature of the printhead, a comparing step of comparing the temperature of the printhead with a predetermined first heating threshold temperature, a heating mode setting step of setting, before a printing operation, a heating mode in which the printhead can be heated if the temperature of the printhead detected by the temperature detecting means is lower than the heating threshold temperature, and a control step of controlling the heating means on the basis of a result of the comparison executed by the comparing means and depending on whether or not the heating mode has been set, the control step executing the heating step to heat the printhead when the heating mode has been set and when the detected temperature of the printhead is lower than the second heating threshold temperature.

According to the present invention, which is arranged as described above, for example, immediately before a printing operation for the first page, the head temperature T is compared with the head first heating threshold temperature (Tth1). If the result of the comparison is $T \leqq Tth1$, then it is determined that the heating mode is to be set. Then, the heating mode setting means sets the heating mode. With the heating mode set, for example, at the start of each printing operation for one line, the temperature T obtained by the detecting means is compared with the heating second threshold temperature (Tth2). Then, if the value T is smaller than the value Tth2, the printhead is heated up to a heating target temperature 2 (Tend2). Further, the heating mode is set to be cleared, for example, five minutes after the setting of the heating mode. Then, even after the head temperature has increased in a low-temperature environment, a heating process can be executed until the entire ink is sufficiently warmed.

The above and other objects, effects, features and advantages of the present invention will become more apparent from the following description of embodiments thereof taken in conjunction with the accompanying drawings.

DETAILED DESCRIPTION OF PREFERRED EMBODIMENTS

[First Embodiment]

Embodiments of the present invention will be described below in detail with reference to the drawings.

First, the configuration of an ink jet printing apparatus according to this embodiment will be described with reference to FIG. 1.

Figure 1:
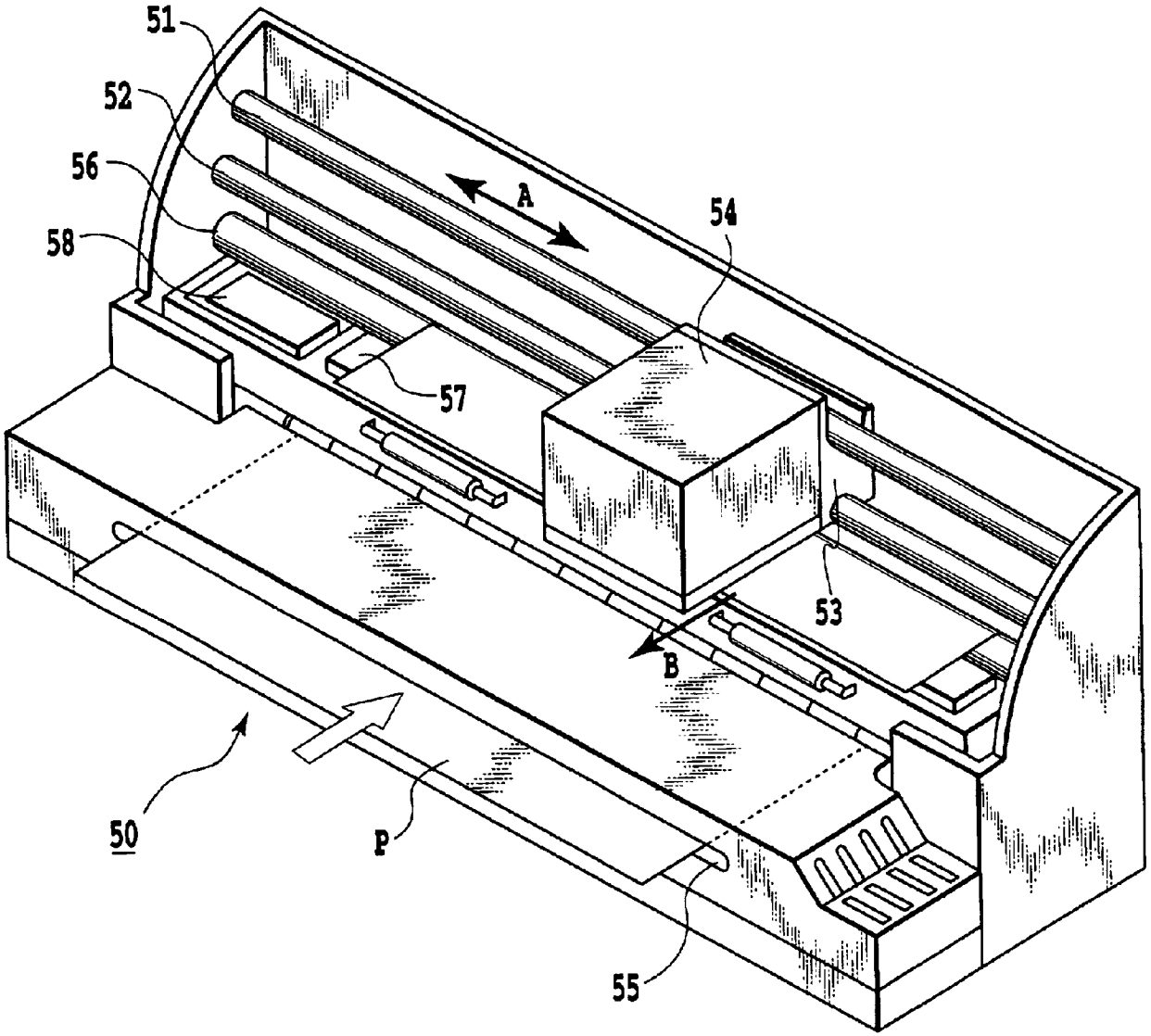
FIG. 1 is a perspective view schematically showing an embodiment of an ink jet printing apparatus according to the present invention.

An ink jet printing apparatus 50, shown in FIG. 1, employs a serial scan method and has a carriage 53 supported along guide shafts 51 and 52 so as to reciprocate along a main-scanning direction, shown by arrow A. The carriage 53 is reciprocated in the main-scanning direction by a carriage motor and a driving force transmitting mechanism such as a belt which transmits driving force. The carriage 53 has a printhead 10 (not shown in FIG. 1) mounted thereon and an ink tank 54 also mounted thereon to supply ink to the print head 10. The printhead 10 and the ink tank 54 may constitute an ink jet cartridge.

Further, a printing medium P is inserted through an insertion port formed in a front surface of the apparatus and is then transported by a feed roller 56 in a sub-scanning direction, shown by arrow B. The ink jet printing apparatus 50 sequentially prints the printing medium by repeating a printing operation of ejecting ink to a printing area of the printing medium on a platen 57 and a transporting operation of transporting the printing medium P in a sub-scanning direction orthogonal to the main-scanning direction.

Further, a recovery system unit 58 is provided at an end (the left end in FIG. 1) of an area in which the carriage 53 is moved, so as to lie opposite that surface of a printhead 101 mounted on the carriage 53 in which nozzles 15 are formed.

Figure 2:
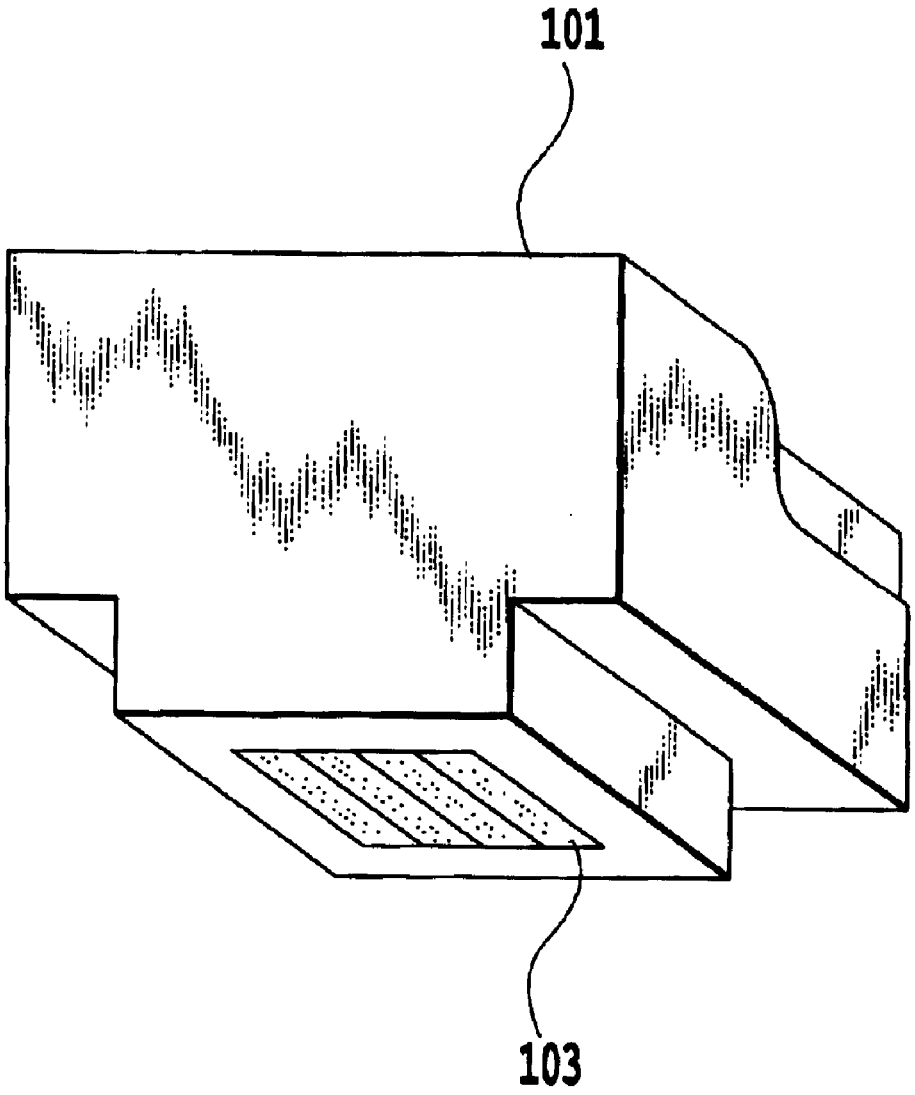
FIG. 2 is a perspective view schematically showing the appearance of a printhead, shown in FIG. 1.
Figure 3:
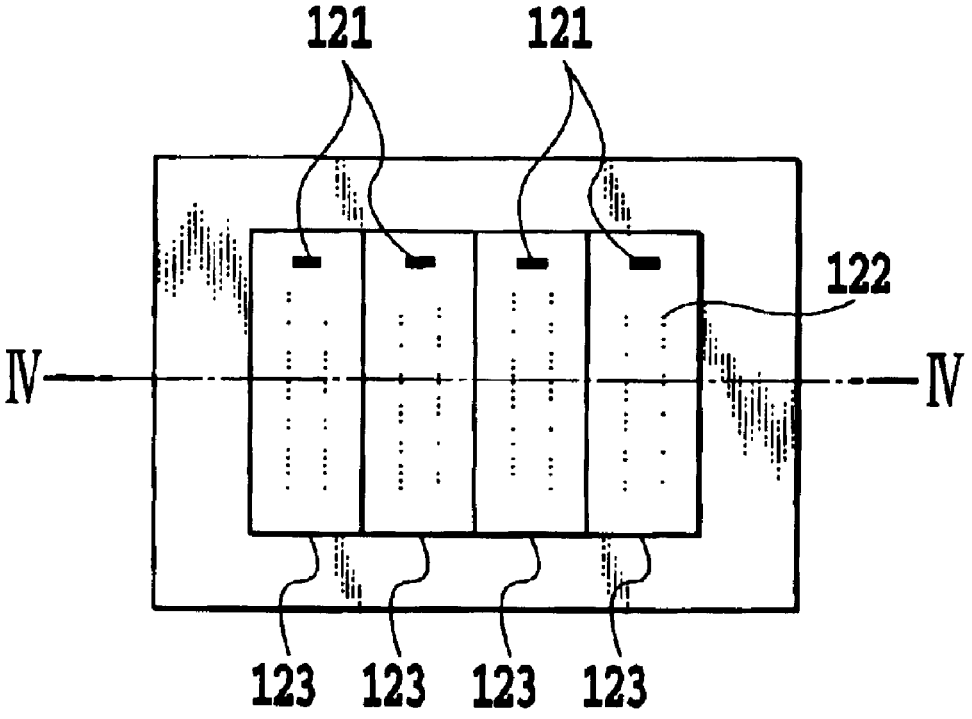
FIG. 3 is a bottom view of the printhead shown in FIG. 2.
Figure 4A:
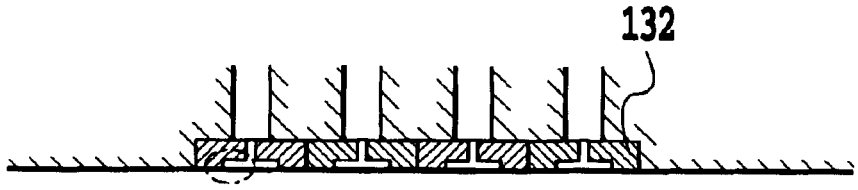
FIG. 4A is a sectional view taken along line IV—IV in FIG. 3.
Figure 4B:
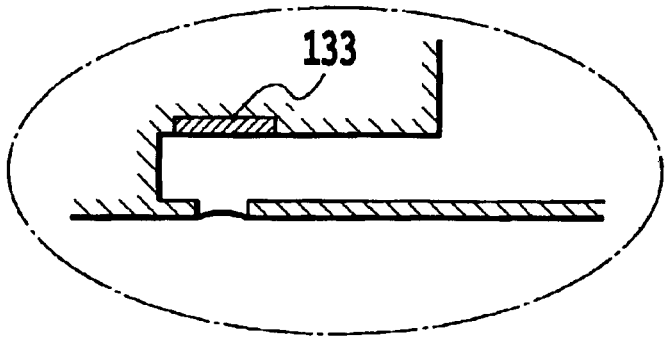
FIG. 4B is a partially enlarged view of FIG. 4A.

FIGS. 2 to 4A and 4B show the configuration of the printhead used in the ink jet printing apparatus according to this embodiment. FIG. 2 is a perspective view of the printhead. FIG. 3 is a bottom view thereof. FIG. 4A is a sectional view taken along line IV—IV in FIG. 3. FIG. 4B is a partially enlarged view of FIG. 4A.

In FIGS. 2 to 4A, a printhead 101 has ejecting sections 132 for a plurality of colors (for example, four colors including yellow, cyan, magenta, and black). Each ejecting section 132 has two nozzle lines having a density of 300 dpi and arranged in parallel at an interval of 600 dpi. This enables each color to be printed at substantially 600 dpi.

Further, in FIG. 4B, reference numeral 133 denotes a heater provided in each nozzle of the printhead 101 as an electrothermal converting element. The heater 133 functions as ejection energy generating means for converting electric energy into thermal energy, which causes bubbles to be generated in ink, so that energy generated by the bubbles can be used to eject the ink. Furthermore, the heater 133 functions as heating means for heating the printhead by providing electric energy insufficient to eject the ink. The heater 133 also functions as a self temperature increasing means.

Further, as shown in FIG. 3, the printhead 101 is provided with a head temperature sensor (temperature detecting means) 121 near the nozzle lines 122 in each ejecting section 123. The head temperature sensor 121 detects the temperature (head temperature) of each ejecting section 123 of the printhead 101.

Figure 5:
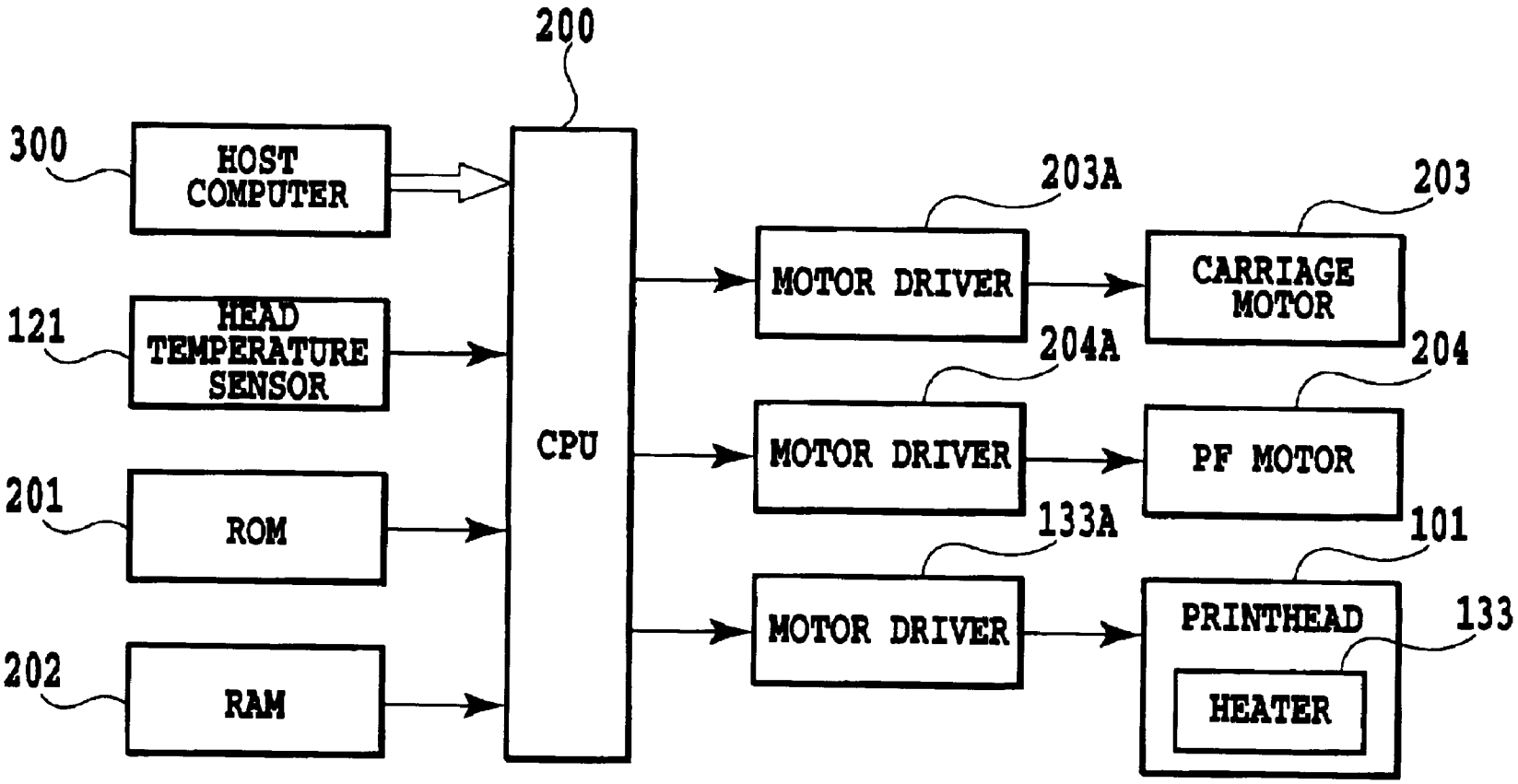
FIG. 5 is a block diagram of a control system according to an embodiment of the present invention.

Further, FIG. 5 is a block diagram schematically showing the configuration of a control system according to this embodiment.

In the figure, reference numeral 200 denotes a CPU that performs operations such as predetermined calculations, counting, comparisons, determinations, and control. Reference numeral 201 denotes a ROM that stores control programs and the like to be executed by the CPU 200. Reference numeral 202 denotes a RAM functioning as a data memory in which data and the like sent out by a host computer are stored and as a working memory that allows the CPU to execute calculating processes. The ROM and the RAM are connected to the CPU 200. Further, the CPU 200, the ROM 201, and the RAM 202 constitute comparing means for performing a comparing operation, described later, heating mode setting means, and control means.

Further, the CPU 200 connects to a heater driver 133 that drives the heaters 133 provided in the printhead 101, a motor driver 133A for a carriage motor 203 acting as a driving source for the carriage 53, a motor driver 204A for a PF motor acting as a driving source for transportation of the printing medium, a head temperature sensor 121 that detects the temperature in the printhead 101, and others.

On the basis of a detected value from the head temperature sensor 121, the CPU 200 executes ejection control by supplying the heater driver 133A with driving data (image data) and a driving control signal (a heat pulse signal) for the ejection heater to cause ink droplets to be ejected from the printhead 101. On the basis of the same detected value, the CPU 200 executes head temperature control to adjust the temperature of the printhead 101. Further, the CPU 200 controls the carriage motor 203 via the motor driver 203A to drive the carriage 53 in the main-scanning direction. On the other hand, it controls the PF motor 204 via the motor driver 204A to transport the printing medium P in the sub-canning direction.

Description will be given of an operation of controlling heating carried out by the heaters 133 which operation is performed by the ink jet printing apparatus configured as described above according to this embodiment.

First, to clarify the features of this embodiment, a heating performance sequence for the heaters 133 in the above ink jet printing apparatus, which sequence is used in the prior art, will be described with reference to FIG. 6.

When a host computer 300 transmits a printing start signal to the CPU 200 (step S1), the CPU 200 resets a counter that counts the number of times that the printhead 101 is heated (step S2). The CPU 200 then loads a head temperature T detected by the head temperature sensor 121 (step S3). In this case, the loaded temperature T is compared with a heating threshold temperature Tth (=20° C.) (step S4). If the head temperature exceeds a preset reference temperature, one line is printed (step S8).

On the other hand, if the head temperature is lower than the reference temperature, the printhead is heated for 10 ms (step S5). Then, a count N in a heating number counter is incremented by one (step S6). Then, it is determined whether or not the count in the heating number counter exceeds an upper limit, for example, 40 (step S7). If the count exceeds the upper limit, the printhead is not further heated but a printing operation is performed (step S8). If the heating number is equal to or smaller than 40, the process returns to step S3 to obtain the temperature. Then, the above operation is repeated for every line or every plural lines until the printing operation is completed (step S9).

The heating number is counted in order to set an upper limit on the heating time for low temperatures to limit a decrease in throughput to below the specified value. Further, if much time is required for heating, a user may determine that there is a failure in the main body. Thus, the heating number counting is also effective in preventing this incorrect determination.

Figure 6:
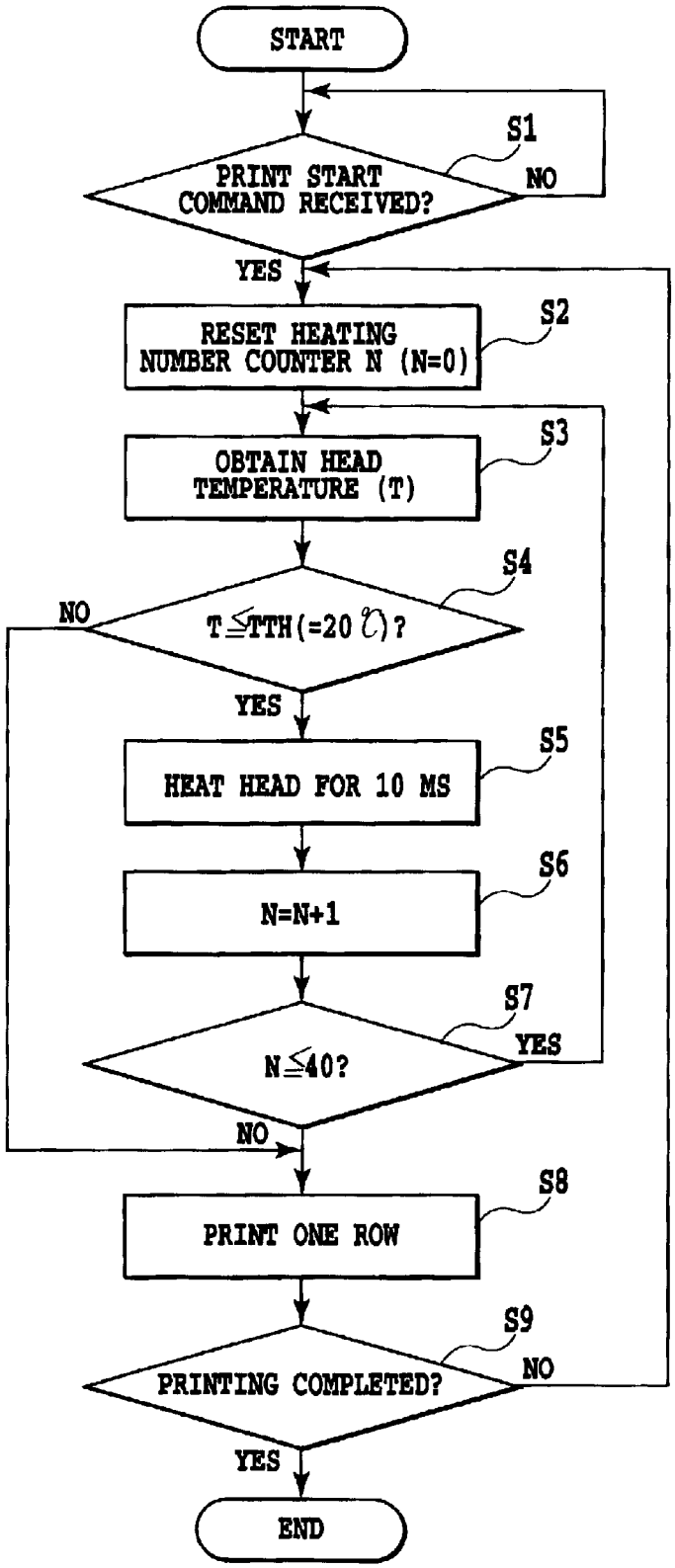
FIG. 6 is a flow chart showing a control operation performed by a conventional ink jet printing apparatus.
Figure 7:
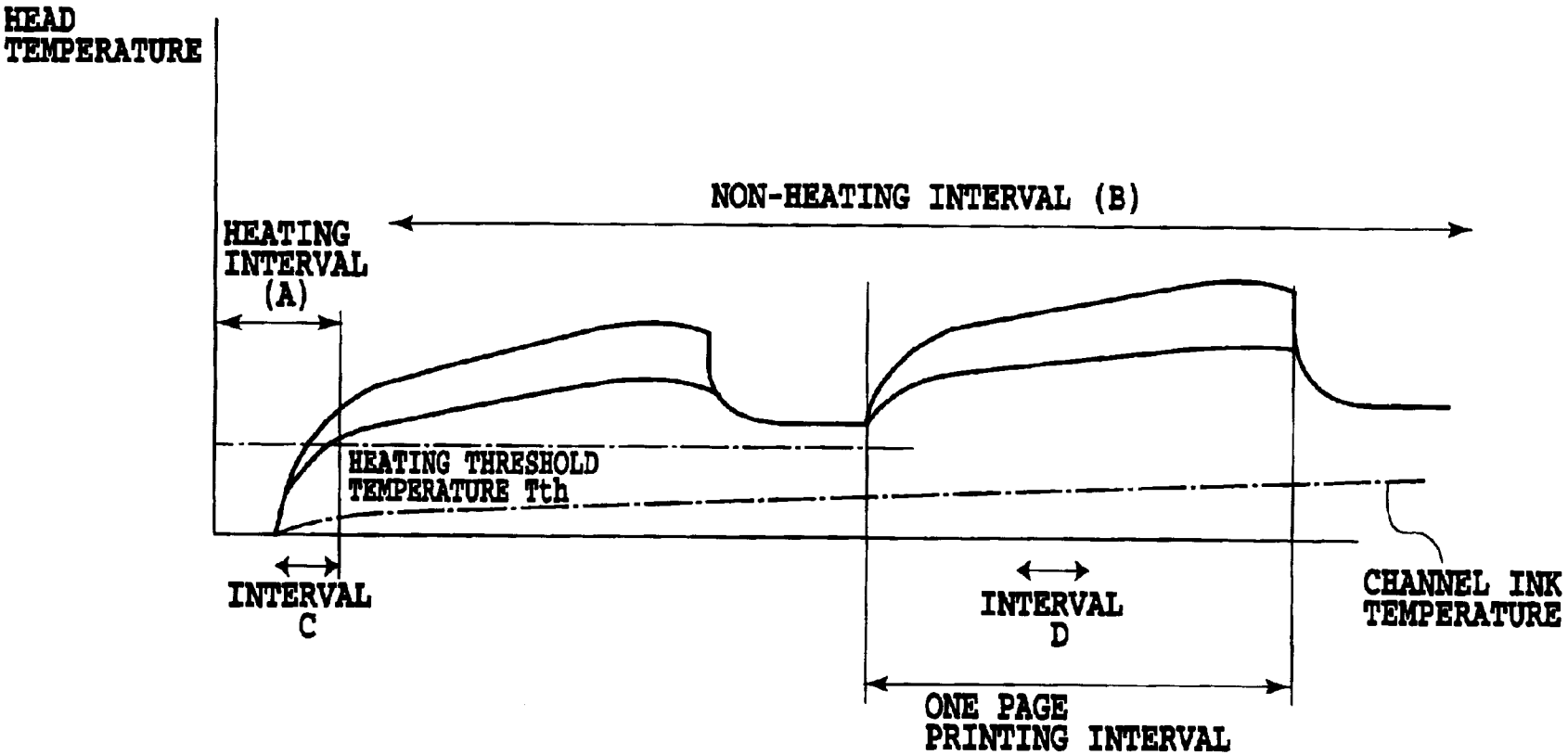
FIG. 7 is a chart showing how the temperature of the printhead is varied by the control operation shown in FIG. 6.

FIG. 7 shows a variation in head temperature which may occur after a printing operation has been started by the control operation shown in FIG. 6.

Figure 8:
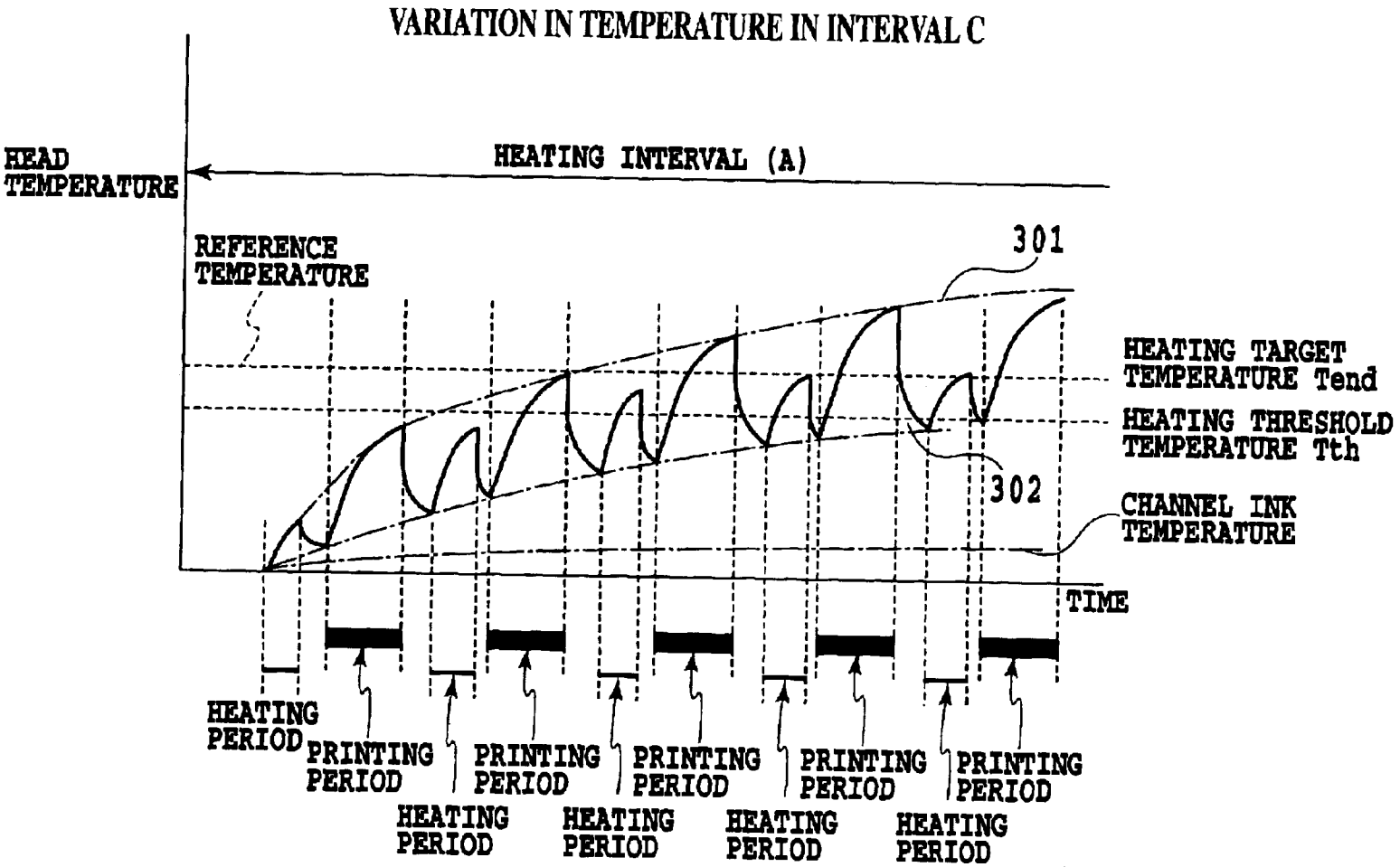
FIG. 8 is a chart showing a section C, shown in FIG. 7, in an enlarged view and also showing a heating period, a printing period, and others.
Figure 9:
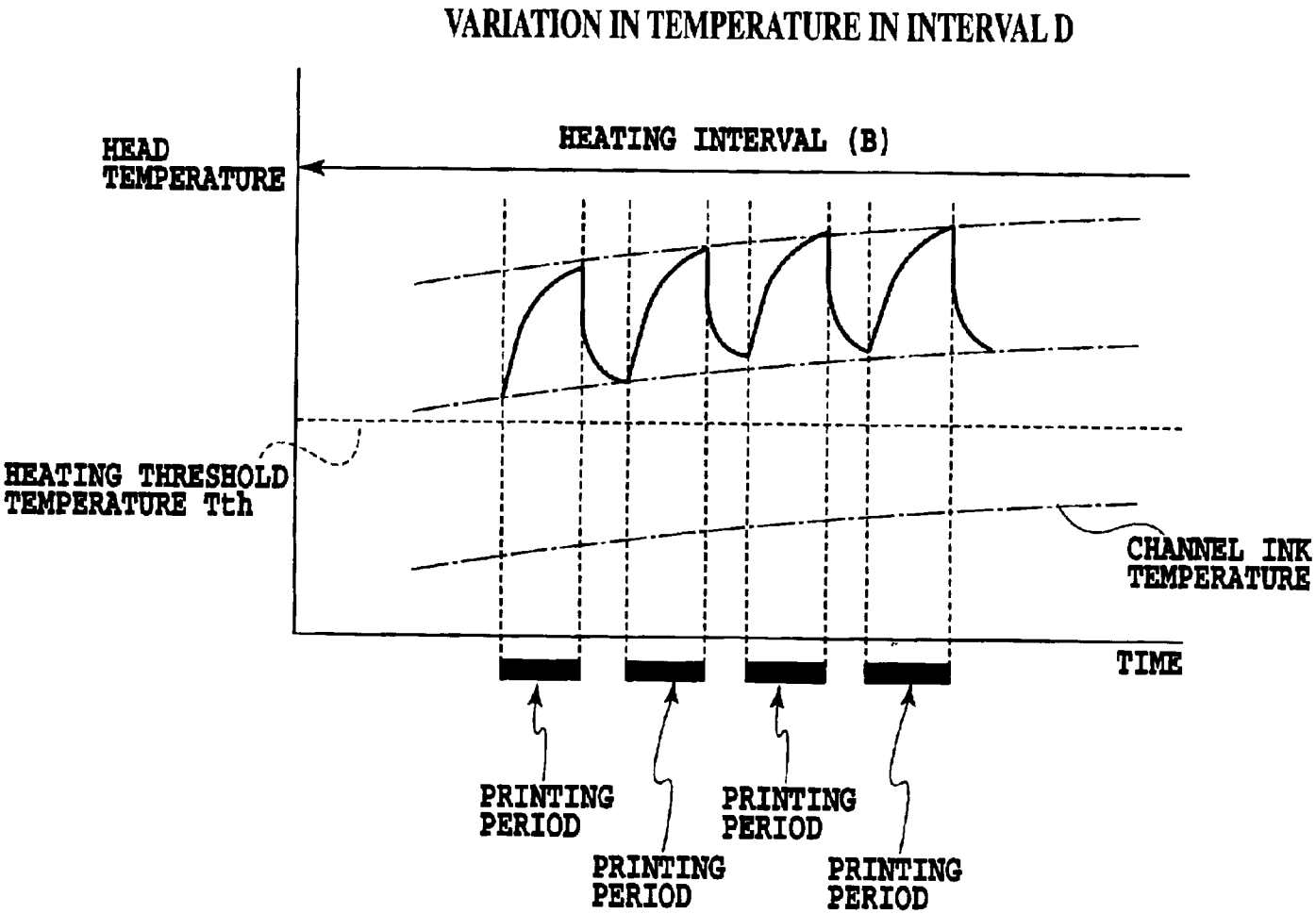
FIG. 9 is a chart showing a section D, shown in FIG. 7, in an enlarged view and also showing a printing period and others.

If the head temperature is equal to or lower than the heating threshold temperature, then a heating operation is performed for a specified time. Then, if the head temperature does not reach the heating threshold temperature after the specified time has passed, the heating operation is stopped and one line is printed. If this printing operation for one line involves a large amount of print data, the temperature increases (self temperature increase) as a result of the heating during the printing operation as shown in the figure. In particular, when an image of nature is printed, a large number of colors are used and dots are densely printed compared to printing of text data in black (Bk text printing). Consequently, the self temperature increase is larger. In a section ending when a reference temperature is reached (a heating section (A) in FIG. 7), the printhead is heated before each printing operation for one line as shown in FIG. 8. In a section for the heating threshold temperature Tth (a non-heating section (B) in FIG. 7), heating is omitted as shown in FIG. 9.

As shown in FIG. 7, if printing of the second page is started without any pause after the first page has been printed, the increase in temperature caused by the printing of the first page may cause the head temperature to exceed the heating threshold value. For example, the heating threshold temperature may be set to be equal to or lower than the normal temperature (for example, 20° C.) in order to avoid a decrease in throughput caused by heating, and the head temperature may increase to about 25° C. at the start of printing of the next page. In this case, as shown in FIG. 7, the head temperature is higher than the heating threshold temperature (=20° C.) in a section D. However, in a low-temperature environment, the temperature of ink ejected remains at 25° C. or lower. Accordingly, compared to the case in which both printhead and ink are 25° C., adverse effects are prone to be produced, for example, the amount of ink ejected may decrease or the density may become non-uniform. However, if only the head temperature is detected, a difference between the normal-temperature environment and the low-temperature environment is not detected. Further, even in the low-temperature environment, heat is transmitted from the head to the ink over time. Consequently, the difference in printing between the normal-temperature environment and the low-temperature environment decreases gradually.

Accordingly, although it is desirable to detect not only the head temperature but also the ink temperature and environmental temperature, provision of a plurality of temperature detecting means increases costs. Further, if the environmental temperature is detected, the temperature detecting means must be located away from heated locations in the printing apparatus in order to eliminate the effects of heating associated with driving of the printing apparatus. Furthermore, if the temperature detecting means is installed on the same substrate, the environmental temperature must be estimated so that the estimated value is corrected in view of the effects of heating. This increases costs and requires complicated control.

Thus, a first embodiment of the present invention provides the following control:

That is, after the command is received, before the first page printed, the detected head temperature T is compared with the heating threshold temperature Tth1 to determine whether or not the environment is in a low-temperature state and heating is thus required. If it is determined that T≦Tth1 and that heating is required, then a heating mode is set in which a heating flag is turned on to enable a heating operation. Then, the detected temperature T, obtained at the start of each printing operation for one line, is compared with a heating threshold temperature Tth2. If the detected temperature T is lower than the heating threshold temperature Tth2, the printhead is heated up to a heating target temperature Tend2 set to be higher than the heating threshold temperature Tth2. Subsequently, if the detected temperature T is compared with the heating threshold temperature Tth1 to determine that the environment is in a low-temperature state, then the heating flag is turned on and five minutes later, turned off to set the heating mode. This enables a heating process to be executed until the temperature of the entire ink increases after the head temperature has increased in the low-temperature environment.

Thus, instead of the printhead 101 alone, the entire printhead 101, including ink, can be heated. Accordingly, the temperature of ink channels in the printhead 101 can be increased. Therefore, the ink stored in the tank and having low temperature can be easily warmed during transfer to the ejection nozzles.

Figure 10:
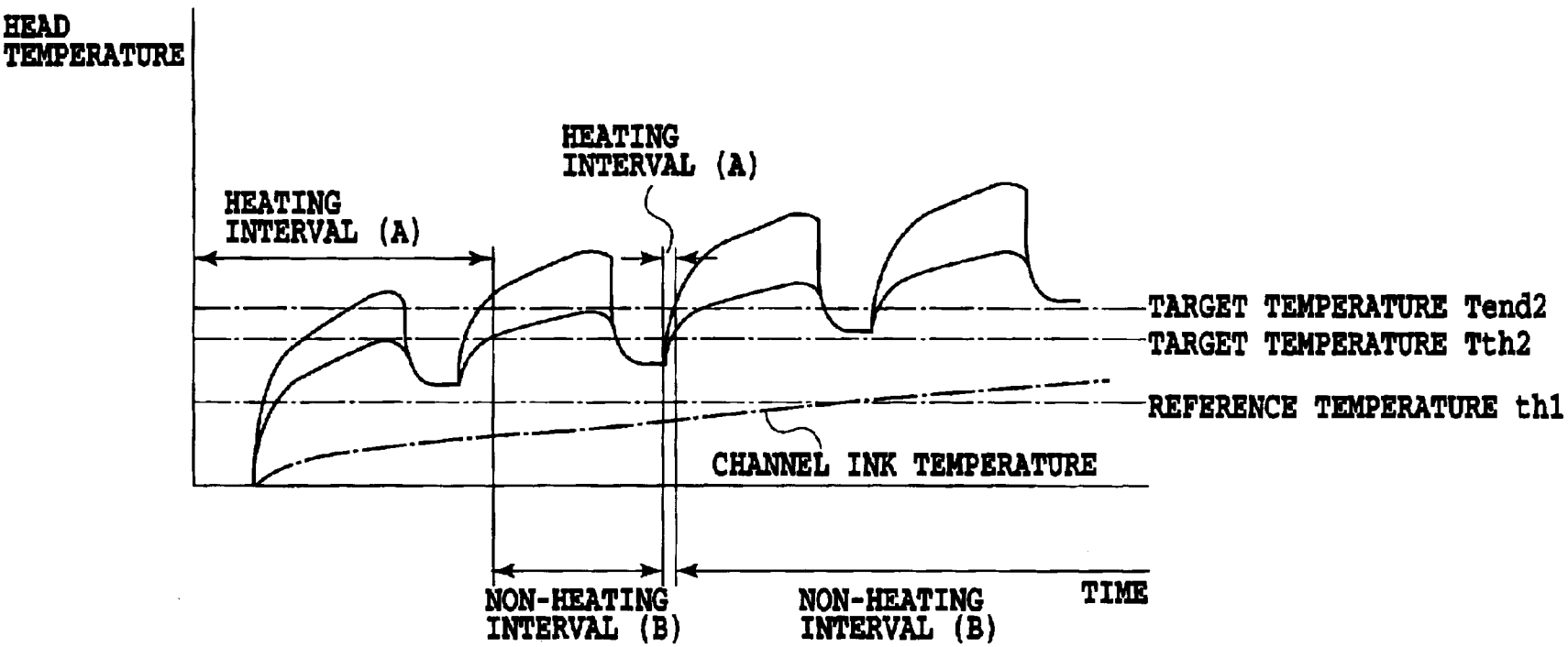
FIG. 10 is a chart showing a variation in temperature of the printhead according to a first embodiment of the present invention.

As described above, in the first embodiment, the heating flag is provided to set and clear the heating mode. Consequently, the heating flag can be turned on for a specified time regardless of the head temperature so as to execute a heating process during this period. Accordingly, the head can be sufficiently heated using only the head temperature detecting means and without the need for a plurality of temperature detecting means for detecting the environmental temperature or the ink temperature, correcting or estimating means, and the like. FIG. 10 shows a variation in head temperature and a variation in temperature of ink in the channels according to the first embodiment. Accordingly, the head can be sufficiently heated using only the head temperature detecting means and without the needs for a plurality of temperature detecting means for detecting the environmental temperature or the ink temperature, correcting or estimating means, and the like. FIG. 10 shows a variation in head temperature and a variation in temperature of ink in the channels according to the first embodiment.

Figures 11, 11A:
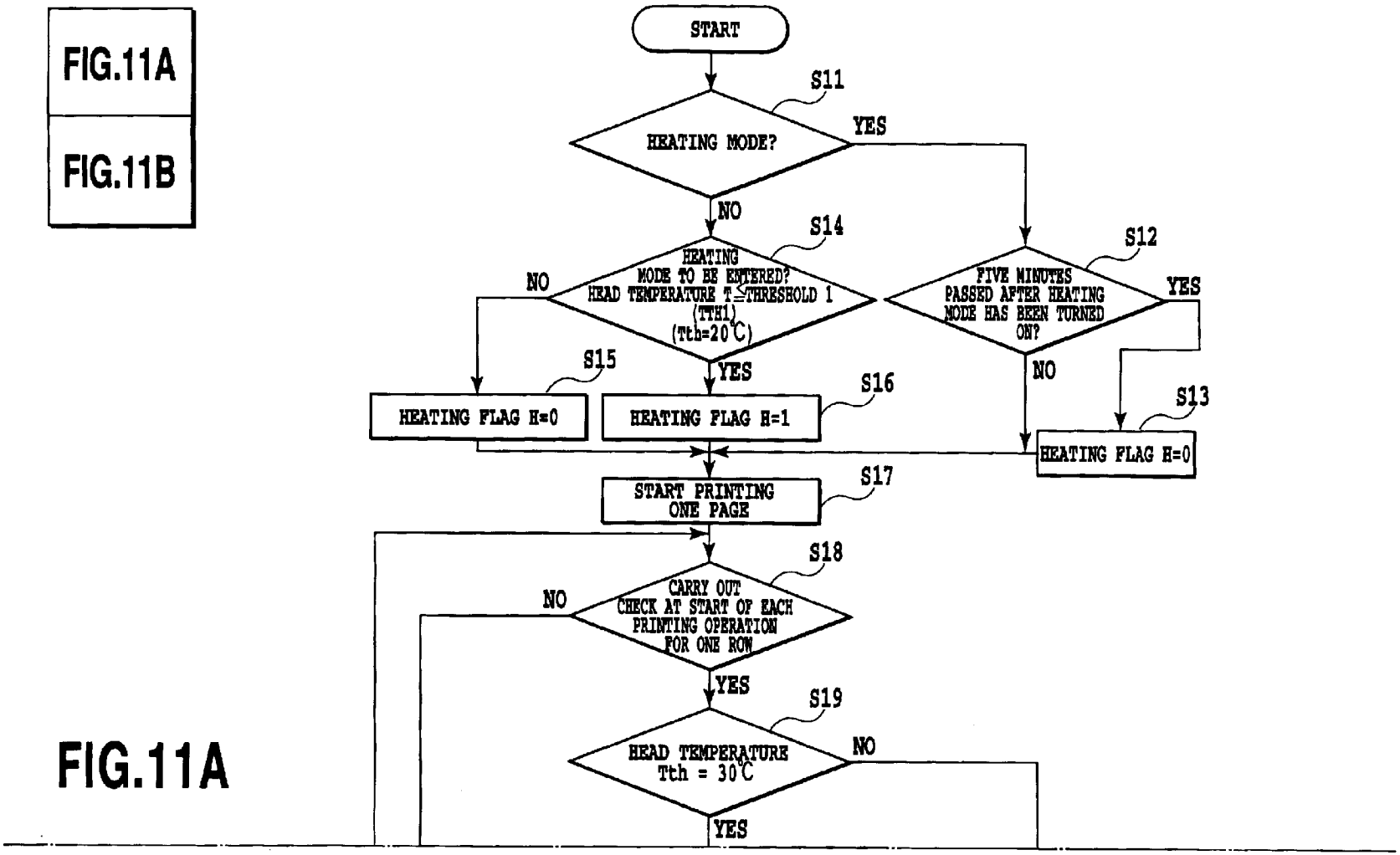
FIG. 11 is a diagram showing the relationship of FIGS. 11A and 11B.
FIGS. 11A and 11B together comprise a flow chart showing a control operation according to the first embodiment performed by the ink jet printing apparatus according to the present invention.
Figure 11B:
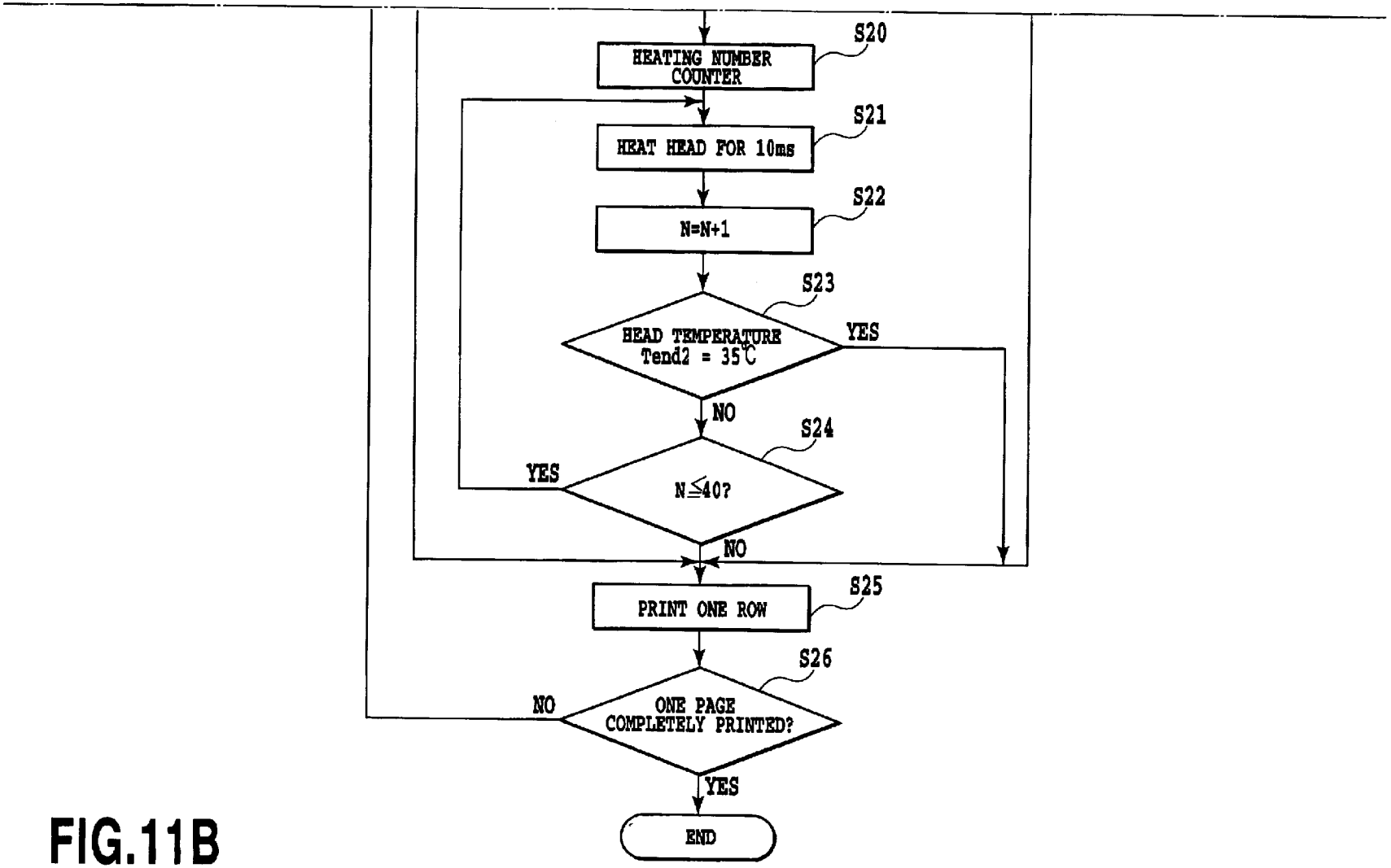

A control operation procedure according to this embodiment will be described in detail with reference to the flow chart in FIGS. 11A and 11B.

First, at step S11, the heating flag H is checked after a print command has been received (after a printing operation has been started). If the heating flag H is off (H=0), the head temperature T is compared with the heating threshold temperature Tth1 (step S14). If T≦Tth1, the heating flag is turned on (H=1) to enter the heating mode (step S16).

On the other hand, at step S14, if it is determined that T>Tth1, the heating flag H is kept off (H=0) (step S15). Thus, the heating mode is not set. Further, at step S11, if a specified time (for example, five minutes) passes after the heating flag H has been turned on (H=1), then the heating flag is turned off (H=0) so as not to enter the heating mode (steps S12 and S13).

Subsequently, a printing operation for one page is started (step S17). At the start of each printing operation for one line, the heating flag H is checked. If the heating flag H is off (H=0), a printing operation is performed without heating the printhead 101 (step S25). On the other hand, if the heating flag H is on (H=1), the head temperature T is compared with the heating threshold temperature Tth2 (for example, 30° C.) to determine whether or not heating is required (whether or not T≦Tth2) (step S19). If it is determined that T>Tth2 and that heating is not required, the process shifts to step S25 to print one line. On the other hand, if it is determined at step S19 that T<Tth2, then during steps S19 to S24, the printhead is heated until the head temperature reaches the heating target temperature Tend2 or the upper limit of the heating time is reached. Then, at step S25, one line is printed.

That is, at step S20, the value N of the heating number counter is reset (N is set to 0). Then, the head is heated for a specified time (for example, 10 ms). Subsequently, the value N of the heating number counter is incremented by one (N=N+1) (step S22). Further, it is determined at step S23 whether or not the head temperature T is equal to or higher than the target temperature Tend2 (for example, 35° C.). If it is determined that T≧Tend2, then at step S25, one line is printed. On the other hand, if it is determined at step S24 that T<Tend2, then it is determined whether or not the count N of the heating number counter is equal to or smaller than 40 (N≦40). Then, if it is determined that N>40, the process shifts to step S25 to print one line. Then, the operations in steps S18 to S26 are repeated until it is determined at step S26 that one page has been completely printed.

Further, if a plurality of pages are consecutively printed in a low-temperature environment, a heating operation is performed on every page printed within a specified time after the start. The heating operation is continuously performed if the head temperature remains at the threshold value Tth1 at the start of the next printing operation performed after a specified time has passed. However, if the head temperature becomes equal to or higher than the value Tth1, it is assumed that heat is transmitted from each ejecting section 123 of the printhead 101 to the entire printhead and ink or that the environmental temperature has increased. Accordingly, in this case, the printhead is not heated.

Thus, the first embodiment does not comprise means for detecting the environmental temperature or ink temperature or means for correcting or estimating a detected temperature, but can sufficiently heat the printhead using only the head temperature detecting means. That is, the printhead can be heated so that even if the head temperature is equivalent to or higher than the normal temperature, adverse effects on images such as a nonuniform density and unwanted stripes are not produced in a low-temperature environment during the first specified time. Further, after the temperature of the entire printhead has increased or if the environment is at the normal temperature, heating of the head is omitted to avoid a decrease in throughput.

In this embodiment, checking whether or not a heating operation is to be performed is carried out before the start of each printing operation for one line. However, it may be carried out every specified time or immediately after each printing operation for one line (before the start of the next printing operation).

[Second Embodiment]

Next, a control operation performed according to a second embodiment will be described with reference to the flow chart in FIGS. 12A and 12B. The second embodiment also has the configuration shown in FIGS. 1 to 5.

When a print command is received, the heating flag H is first checked to determine whether or not the heating mode H has been set (step S21). If the heating mode H has not been set, the head temperature T is compared with the heating threshold temperature Tth1 (step S22). If the head temperature T is equal to or higher than the heating threshold temperature Tth1, the heating flag H is turned off (H=0). Then, a printing operation for one page is started without heating the printhead (step S26). Further, if it is determined that the head temperature T is lower than the heating threshold temperature Tth1, the heating flag H is turned on (H=1). Then, the target temperature Tend1, a heating time Theat1, and the number of repetitions L1 are set, and a heating sequence is executed (step S25).

Figures 12, 12A:
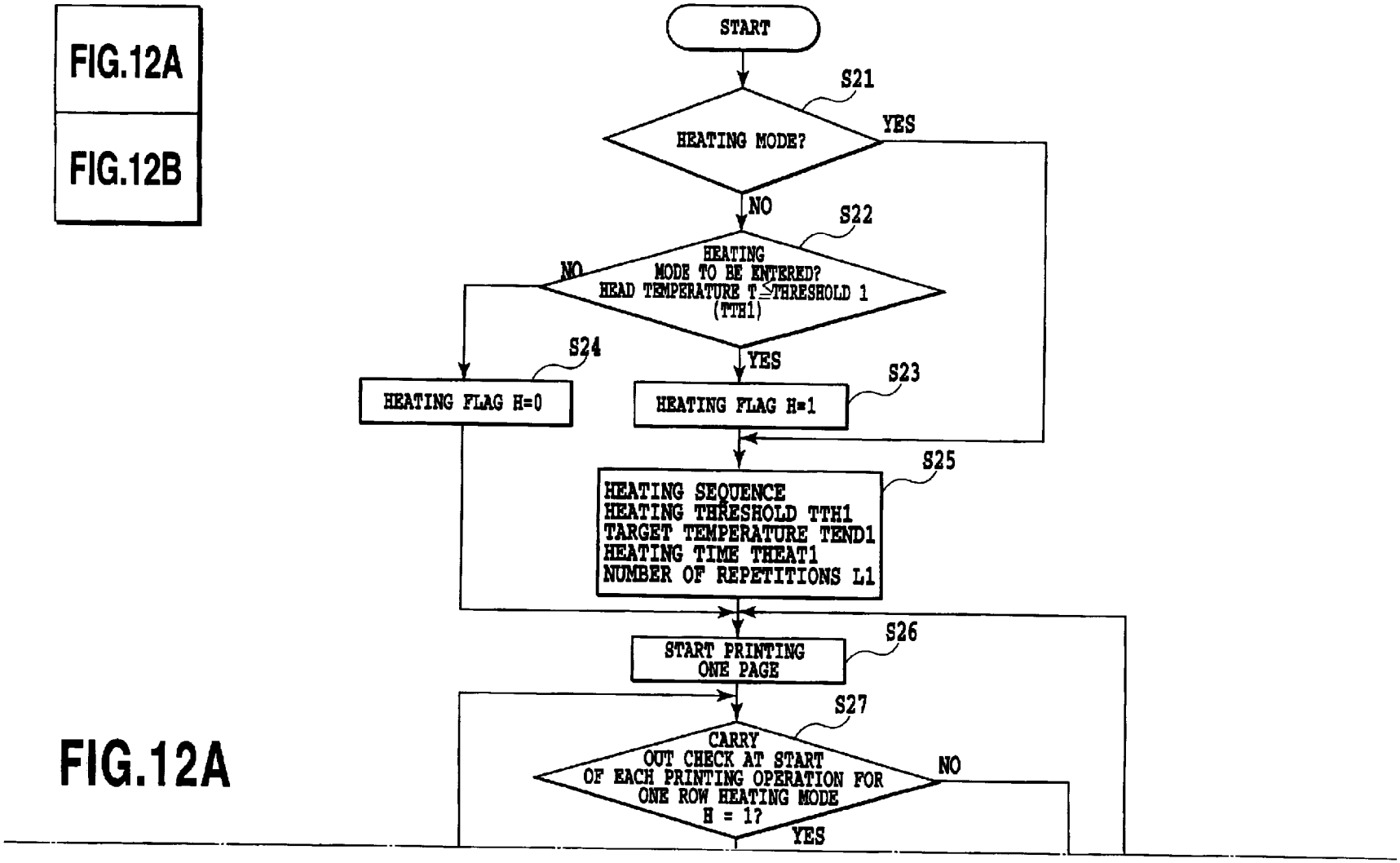
FIG. 12 is diagram showing the relationship of FIGS. 12A and 12B.
FIGS. 12A and 12B together comprise a flow chart showing a control operation according to a second embodiment performed by the ink jet printing apparatus according to the present invention.
Figure 12B:
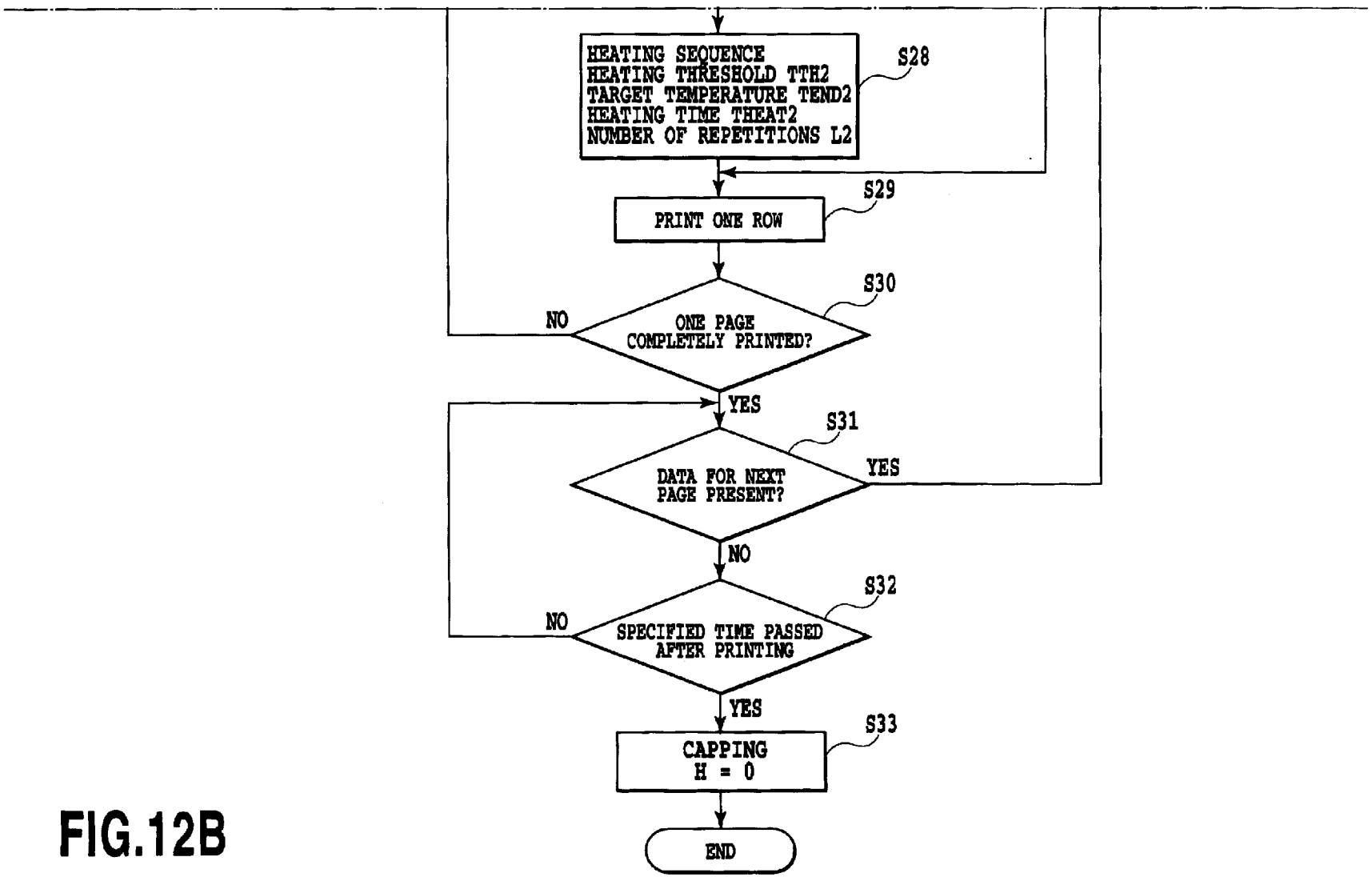

FIGS. 12A and 12B show this heating sequence. In the heating sequence, a heating operation is repeated until the head temperature reaches the heating target temperature or the number of repetitions reaches a specified value.

That is, at step S41, the head temperature T is compared with the heating threshold temperature (in this case, Tth1). If it is determined that the head temperature is lower than the heating threshold temperature and that the printhead must thus be heated, then the value N of the heating number counter is reset (N=0) (step S42). Then, at step S43, the printhead 101 is heated. Subsequently, at step S44, the value N of the heating number counter is incremented by one (N=N+1).

Subsequently, at step S45, the head temperature T is compared with the heating target temperature (in this case, Tend1). If the head temperature is equal to or higher than the heating target temperature, the heating sequence is ended. On the other hand, if the head temperature is lower than the heating target temperature, the process shifts to step S46. At step S46, it is determined whether or not the value N of the heating number counter has reached the predetermined number of repetitions. Then, the operations in steps S43 to S46 are repeated until the predetermined number of repetitions is reached.

After the above described heating sequence has been executed, a printing operation for one page is started at step S26, shown in FIG. 12. That is, before the start of each printing operation for one line, the heating mode flag H is checked to determine whether or not the heating mode has been entered. If the heating mode has not been entered, one line is printed at step S29. If the heating mode has been entered, the target temperature Tend2, the heating time Theat1, and the number of repetitions L1 are set and the heating sequence described previously and shown in FIG. 13 is executed (step S28). Subsequently, at step S29, one line is printed to determine whether or not one page has been completely printed (step S30). Then, if it is determined that the printing operation has not been completed, the process returns to step S27 to repeat the series of operations ending at step S30. If it is determined that one page has been completely printed, then it is determined at step S31 whether or not print data for the next page are present (step S31). The operations in steps S26 to S31 are repeated until print data for all pages are printed. Once the print data for all pages have been printed, a cap member (not shown) is used to cover the ejecting sections of the printhead, and the flag H is turned on (H=0) (steps S32 and S33).

In the second embodiment, the heating target temperature is set to be higher than the heating threshold temperature. However, the heating target temperature may be set to equal the heating threshold temperature.

Thus, in this embodiment, in addition to a heating operation for each line within a page, a heating operation is performed at the top of the page. Thus, the page is ensured to be printed at the desirable head temperature from its top. Further, a heating operation is performed for every line, thereby reducing a variation in time interval between printing scans. Further, the printing operation performed during page feeding is effective in minimizing a decrease in throughput.

Figure 13:
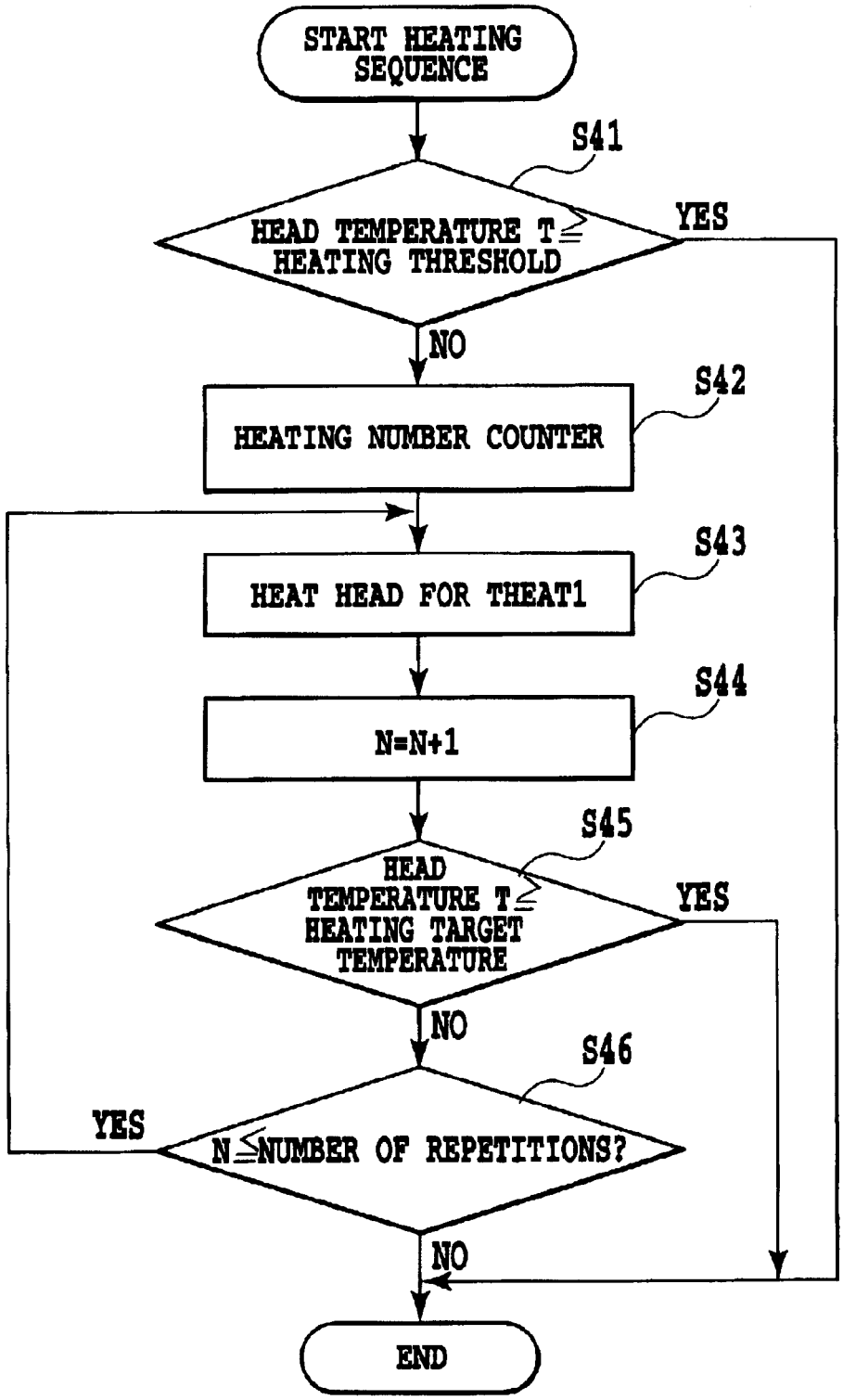
FIG. 13 is a flow chart showing a heating sequence used during the control operation shown in FIG. 12.

Furthermore, for a heating operation performed after page feeding, the heating flag is checked at the start of each printing operation for one line as in the first embodiment (step S27). If the heating flag indicates H=1, the heating sequence shown in FIG. 13 is executed. This is repeated until one page is completely printed (steps S28 to S30). Further, in the first embodiment, such control is provided that the heating flag is turned off a specified time after it has been turned on. However, in the second embodiment, a specified time after a printing operation has been completed, the heating flag H is turned off (H=0) synchronously with a capping operation performed to protect the printhead (step S33). Thus, the heating flag can be turned on and off without the need to additionally execute a timer process for the heating flag.

Alternatively, the heating flag may be turned off on the basis of the number of sheets printed after the heating flag has been turned on or a preset upper limit value for the predetermined head temperature.

Alternatively, in the above described embodiments, the heating means for the printhead is composed of the heaters for ink ejection provided in the respective nozzles in each ejecting section of the printhead. However, heaters different from those for ink ejection may be used. However, in either case, the upper limit of the ink heating temperature in the heating mode must be such that ink is not ejected through the nozzles at this temperature. Further, the heating means may be provided not only in the nozzles but also outside them.

As described above, according to the present invention, if the detected temperature of the printhead is lower than the heating first threshold temperature, the heating mode, in which the printhead can be heated, is set before a printing operation. Further, when the heating mode is set and the detected temperature of the printhead is lower than the heating second threshold temperature, the heating means heats the printhead. Consequently, even in a low-temperature environment, the heating operation keeps ink good and suitable for printing. Further, ink is stably ejected to enable a proper image to be printed. Moreover, at the normal temperature, the heating operation is unwanted and thus omitted, thereby achieving efficient ink temperature retention control. Furthermore, this embodiment does not require a plurality of detecting means for detecting the environmental temperature or head temperature or require a detected temperature to be corrected. Therefore, this embodiment can be inexpensively and simply constructed.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. An ink jet printing apparatus that carries out printing by ejecting ink to a printing medium through nozzles formed in a printhead, the apparatus comprising:

heating means for heating the printhead;

temperature detecting means for detecting the temperature of the printhead;

comparing means for comparing the temperature of the printhead with a predetermined first heating threshold temperature;

heating mode setting means for setting, before a printing operation, a heating mode in which the printhead can be heated if the temperature of the printhead is lower than the first heating threshold temperature; and control means for controlling said heating means to heat the printhead in the case where the heating mode has been set and in the case where the detected temperature of the printhead is lower than a second heating threshold temperature that is higher than the first heating threshold temperature.

2. An ink jet printing apparatus according to claim 1, wherein said heating mode setting means clears setting of the heating mode a specified time after the heating mode has been set.

3. An ink jet printing apparatus according to claim 1, wherein said heating mode setting means clears setting of the heating mode in response to capping of the printhead.

4. An ink jet printing apparatus according to claim 1, wherein said heating mode setting means clears setting of the heating mode on the basis of the number of sheets printed after setting of the heating mode.

5. An ink jet printing apparatus according to claim 1, wherein said heating mode setting means clears setting of the heating mode when the temperature of the printhead reaches a predetermined temperature.

6. A method of controlling temperature of a printhead of an ink jet printing apparatus that carries out printing by ejecting ink to a printing medium through nozzles formed in the printhead, the method comprising:

a heating step of heating the printhead;

a temperature detecting step of detecting the temperature of the printhead;

a comparing step of comparing the temperature of the printhead with a predetermined first heating threshold temperature;

a heating mode setting step of setting, before a printing operation, a heating mode in which the printhead can be heated if the temperature of the printhead is lower than the first heating threshold temperature; and a control step of executing said heating step to heat the printhead in the case where the heating mode has been set and in the case where the detected temperature of the printhead is lower than a second heating threshold temperature that is higher than the first heating threshold temperature.

7. A method according to claim 6, wherein in the case where a plurality of pages are printed continuously, the heating mode is set prior to a printing operation for a first page.

8. An ink jet printing apparatus according to claim 1, wherein in the case where a plurality of pages are printed continuously, the heating mode is set prior to a printing operation for a first page.

9. An ink jet printing apparatus that carries out printing by ejecting ink to a printing medium through nozzles formed in a printhead, the apparatus comprising:

heating means for heating the printhead;

temperature detecting means for detecting the temperature of the printhead;

comparing means for comparing the temperature of the printhead with a predetermined heating threshold temperature;

heating mode setting means for setting, before a printing operation, a heating mode in which the printhead can be heated if the temperature of the printhead is lower than the predetermined heating threshold temperature; and controlling means for controlling said heating means to heat the printhead prior to the printing operation and between an end of a line and a start of a line subsequent thereto, in the case where the heating mode has been set.

* * * * *